US005467751A

United States Patent [19]

Kumagai

[11] Patent Number: 5,467,751

[45] Date of Patent: Nov. 21, 1995

[54] THROTTLE VALVE CONTROL SYSTEM

[75] Inventor: Masato Kumagai, Atsugi, Japan

[73] Assignee: Unisia Jecs Corporation, Atsugi, Japan

[21] Appl. No.: 226,083

[22] Filed: Apr. 11, 1994

[30] Foreign Application Priority Data

Apr. 13, 1993 [JP] Japan ..... 5-086465

[51] Int. Cl.[6] ..... F02D 7/00

[52] U.S. Cl. ..... 123/399

[58] Field of Search ..... 123/399, 400, 123/396; 477/107

[56] References Cited

U.S. PATENT DOCUMENTS

| | | | |
|---|---|---|---|
| 5,161,507 | 11/1992 | Terazawa et al. | 123/399 |
| 5,172,668 | 12/1992 | Gohring et al. | 123/399 |
| 5,178,112 | 1/1993 | Terazawa et al. | 123/399 |
| 5,215,057 | 6/1993 | Sato et al. | 123/400 |
| 5,241,936 | 9/1993 | Byler et al. | 123/399 |
| 5,265,572 | 11/1993 | Kadomukai et al. | 123/396 |
| 5,269,273 | 12/1993 | Yasuda et al. | 123/399 |
| 5,293,855 | 3/1994 | Nakamura | 123/399 |
| 5,297,522 | 3/1994 | Buchl | 123/399 |
| 5,366,424 | 11/1994 | Wataya | 477/107 |

FOREIGN PATENT DOCUMENTS

| | | | |
|---|---|---|---|
| 3-61654 | 3/1991 | Japan | 123/399 |
| 5-248275 | 9/1993 | Japan | 123/399 |

*Primary Examiner*—Raymond A. Nelli
*Attorney, Agent, or Firm*—Foley & Lardner

[57] ABSTRACT

A throttle valve control system for an internal combustion engine mounted on a motor vehicle comprises a first device which determines necessity of controlling a throttle valve irrespective of operation of an accelerator pedal upon sensing a predetermined operation condition of the vehicle; a second device which devices a target opening degree of the throttle valve from the existing depression degree of an accelerator pedal with reference to a data-map, the data-map showing a relationship between the opening degree of the throttle valve, the depression degree of the accelerator pedal and the operation condition of the vehicle; a third device which compares the existing opening degree of the throttle valve and the derived target opening degree of the same; and a fourth device which controls the opening degree of the throttle valve in accordance with a result of the comparison of the opening degree.

5 Claims, 5 Drawing Sheets

THROTTLE VALVE CONTROL SYSTEM

BACKGROUND OF THE INVENTION

1. Field of the Invention

The present invention relates in general to a throttle valve control system of an automotive internal combustion engine, and more particularly to a control system which, under a given condition of the associated motor vehicle, reduces automatically the opening degree of the throttle valve irrespective of operation of an accelerator pedal.

2. Description of the Prior Art

Hitherto, in motor vehicles powered by an internal combustion engine, a traction control system has been proposed and put into a practical use which controls the driving torque of the engine in accordance with the driving force actually needed by the vehicle under running. Such control systems are very useful in controlling the vehicle which is under running on a slippery road, such as, a iced road and a snow-covered road.

One of such control systems are of a type which has, in addition to a first throttle valve directly controlled by an accelerator pedal, a second throttle valve connected in series with the first throttle valve. That is, when, under running of the vehicle, a slip of road wheels of the vehicle is detected, the control system reduces the opening degree of the second throttle valve to reduce the driving torque of the engine thereby lowering the driving force of the vehicle. With this, undesired swerving phenomenon of the vehicle is suppressed or at least minimized. However, due to provision of the second throttle valve, the entire of the control system become large in size.

In order to solve such drawback in size, Japanese Patent First Provisional Publication 3-61654 proposes another control system which uses only one throttle valve. That is, under normal cruising condition of the vehicle, the opening degree of the throttle valve is directly controlled by the accelerator pedal. While, upon sensing the need of the traction control, the opening degree of the throttle valve is automatically controlled or reduced irrespective of operation of the accelerator pedal. In the control system proposed by the publication, a butterfly-type throttle valve is employed which is connected to a spring-biased throttle shaft to pivot therewith. By the spring, the throttle valve is biased in a direction to close the associated throat. An operation lever actuated by the accelerator pedal is pivotally connected to the throttle shaft, and a control lever actuated by an electronically controlled actuator is connected to the throttle shaft. A so-called "lost motion lever" is further connected to the throttle shaft, which becomes engaged with the operation lever in response to pivoting of the operation lever in the valve closing direction. A lost motion spring is interposed between the operation lever and the lost motion lever to bias them in a direction to establish engagement therebetween.

However, in the control system of the above-mentioned Japanese publication, the throttle valve arrangement needs a number of parts and thus the construction of the arrangement becomes very complicated. Furthermore, due to increase in number of the parts used, the arrangement needs greater assembly time and thus greater cost.

In view of the above-mentioned drawbacks possessed by the conventional systems, the inventors have proposed a new control system which is shown in Japanese Patent First Provisional Publication 5-248275. In this new system, the number of parts used is reduced.

SUMMARY OF THE INVENTION

It is an object of the present invention to provide a throttle valve control system which is provided by taking the above-mentioned drawbacks into consideration.

According to the present invention, there is provided a throttle valve control system which can control the throttle valve optimally in accordance with the operation condition of the motor vehicle.

According to a first aspect of the present invention, there is provided a throttle valve control system for use in a motor vehicle powered by an internal combustion engine and having an accelerator pedal, the engine having a throttle valve for controlling a driving torque produced thereby. The throttle valve control system comprises first means for determining necessity of controlling the throttle valve irrespective of operation of the accelerator pedal upon sensing a predetermined operation condition of the vehicle; second means for deriving a target opening degree of the throttle valve from the existing depression degree of the accelerator pedal with reference to a data-map, the data-map showing a relationship between the opening degree of the throttle valve, the depression degree of the accelerator pedal and the operation condition of the vehicle; third means for comparing the existing opening degree of the throttle valve and the derived target opening degree of the same; and fourth means for controlling the opening degree of the throttle valve in accordance with a result of said comparison of the opening degree.

According to a second aspect of the present invention, there is provided a throttle valve control system for use in a motor vehicle powered by an internal combustion engine which has a throttle valve for controlling a driving torque produced thereby. The throttle valve control system includes a first structure rotated upon operation of an accelerator pedal and having a first connecting portion; a second structure rotated upon operation of an electric actuator and having a second connecting portion; a third structure rotated together with the throttle valve and having a third connecting portion; and a connection lever pivotally connected to the first, second and third connecting portions, at least two of the first, second and third connecting portions being permitted to make an axial movement relative to the connection lever, so that when, under rest of the second structure, the first structure is rotated by the accelerator pedal, the first connecting portion forces the connection lever to pivot about the second connecting portion causing the third connecting portion to pivot the throttle valve, and when, under rest of the first structure, the second structure is rotated by the electric actuator, the second connecting portion forces the connection lever to pivot about the first connecting portion causing the third connecting portion to pivot the throttle valve, the throttle valve control system being characterized by first means for determining necessity of controlling the throttle valve irrespective of operation of the accelerator pedal upon sensing a predetermined operation condition of the vehicle; second means for deriving a target opening degree of the throttle valve from the existing depression degree of the accelerator pedal with reference to a data-map, the data-map showing a relationship between the opening degree of the throttle valve, the depression degree of the accelerator pedal and the operation condition of the vehicle; third means for comparing the existing opening degree of the throttle valve and the derived target opening degree of the same; and fourth means for controlling the opening degree of the throttle valve in accordance with a result of the comparison of the opening degree.

According to a third aspect of the present invention, there is provided a method for controlling a throttle valve of an internal combustion engine mounted on a motor vehicle, the engine including a throttle valve control device which has a first structure rotated upon operation of an accelerator pedal and having a first connecting portion; a second structure rotated upon operation of an electric actuator and having a second connecting portion; a third structure rotated together with the throttle valve and having a third connecting portion; and a connection lever pivotally connected to the first, second and third connecting portions, at least two of the first, second and third connecting portions being permitted to make an axial movement relative to the connection lever, so that when, under rest of the second structure, the first structure is rotated by the accelerator pedal, the first connecting portion forces the connection lever to pivot about the second connecting portion causing the third connecting portion to pivot the throttle valve, and when, under rest of the first structure, the second structure is rotated by the electric actuator, the second connecting portion forces the connection lever to pivot about the first connecting portion causing the third connecting portion to pivot the throttle valve. The method comprises the steps of determining necessity of controlling the throttle valve irrespective of operation of the accelerator pedal upon sensing a predetermined operation condition of the vehicle; deriving a target opening degree of the throttle valve from the existing depression degree of the accelerator pedal with reference to a data-map, the data-map showing a relationship between the opening degree of the throttle valve, the depression degree of the accelerator pedal and the operation condition of the vehicle; comparing the existing opening degree of the throttle valve and the derived target opening degree of the same; and controlling the opening degree of the throttle valve in accordance with a result of the comparison of the opening degree.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the present invention will be described in detail with reference to the accompanying drawings.

Referring to FIGS. 1 to 4 of the accompanying drawings, there is shown a throttle valve control device of an automotive internal combustion engine, to which the present invention is practically applied.

Figure 1:
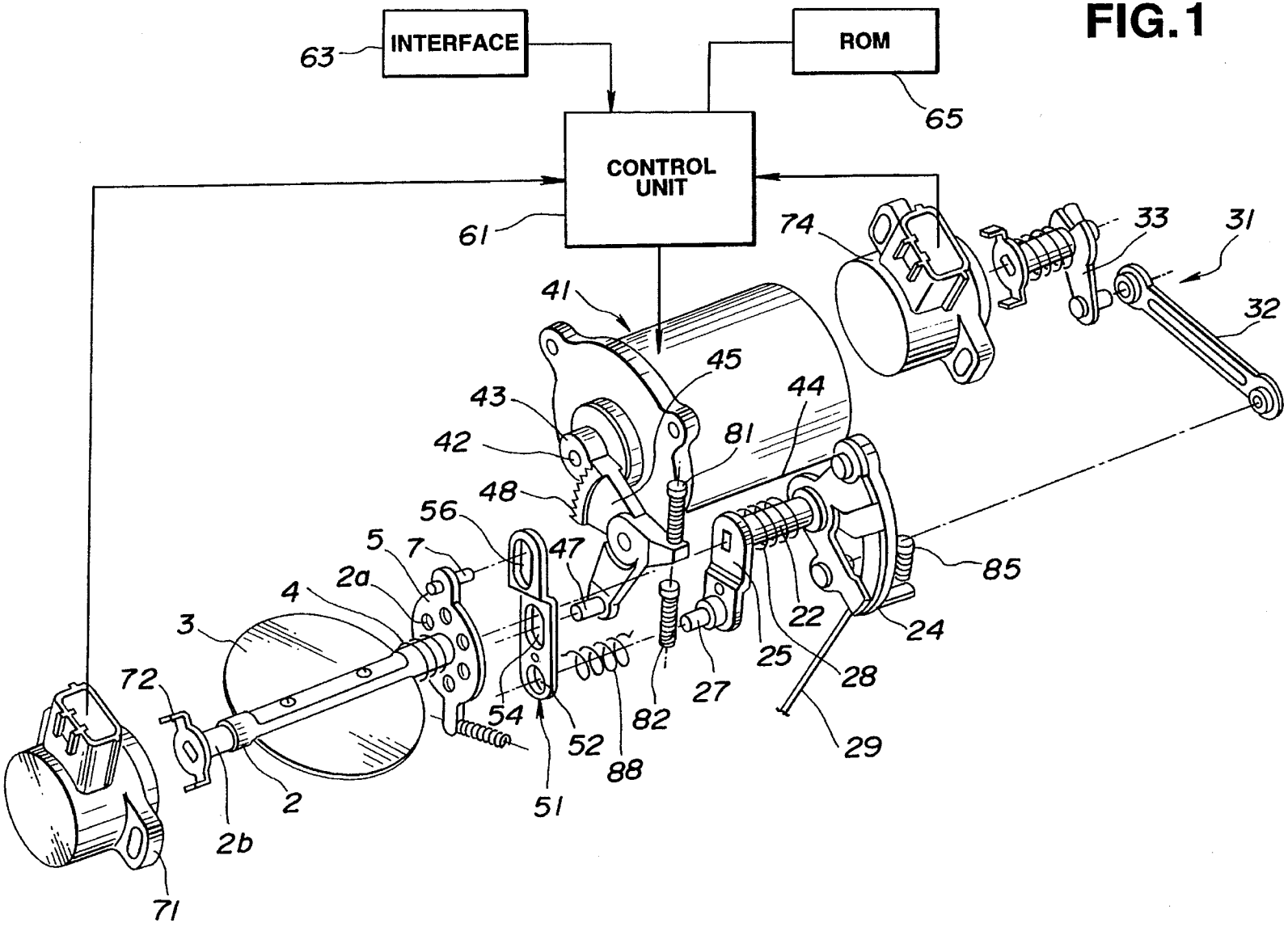
FIG. 1 is a perspective view of a throttle valve control device to which the present invention is practically applied.
Figure 2:
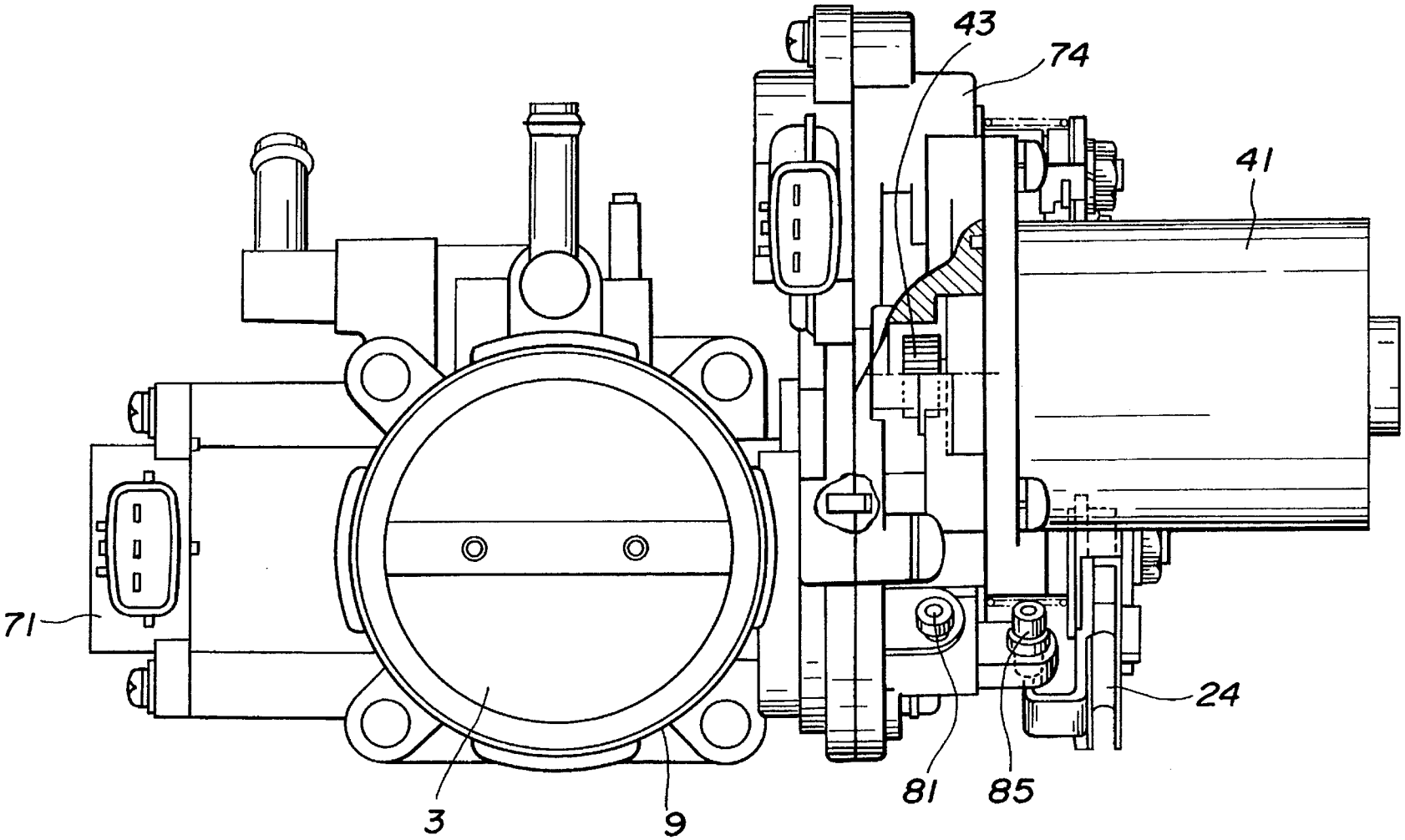
FIG. 2 is a plan view of the throttle valve control device.
Figure 3:
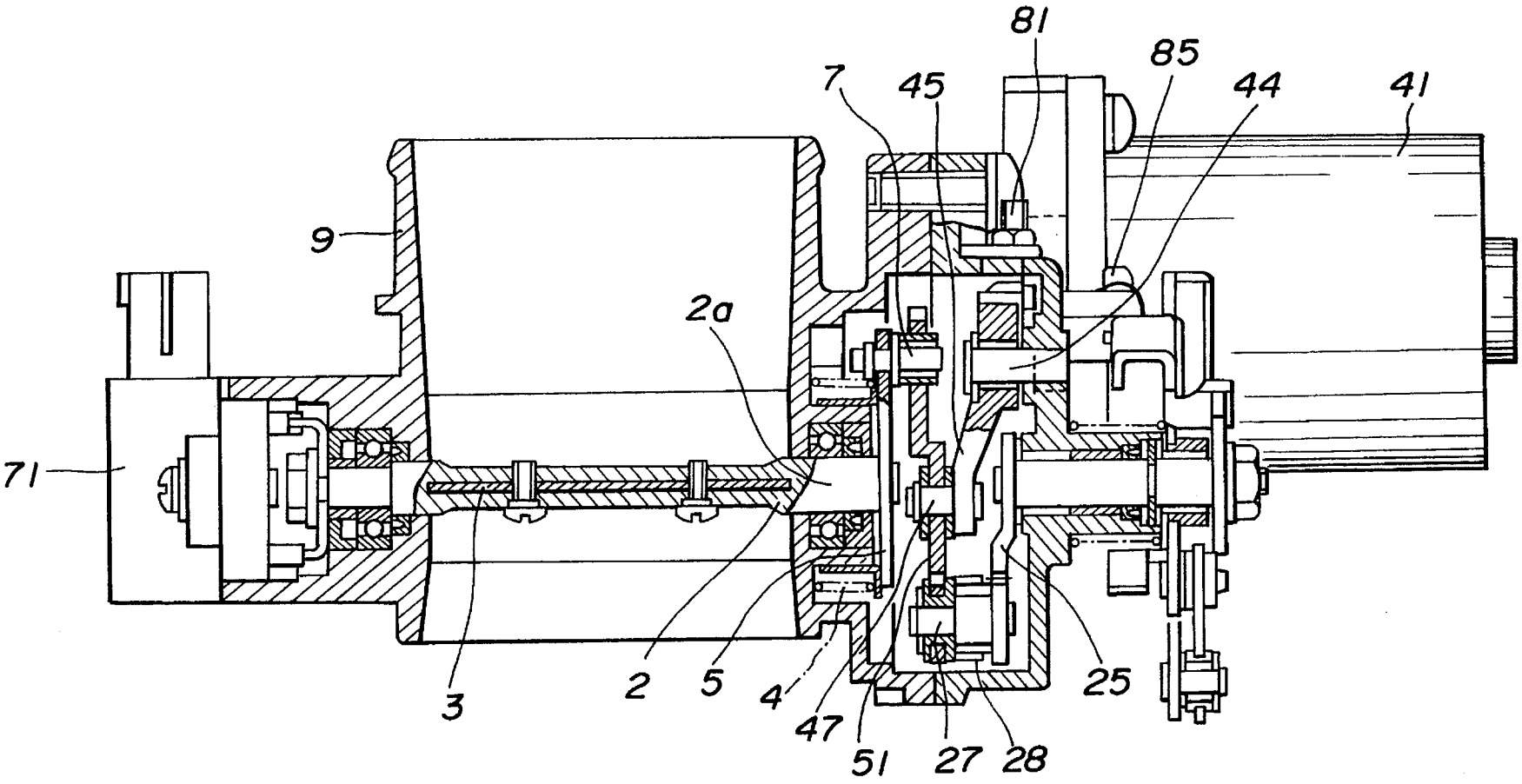
FIG. 3 is a front, but partially sectioned, view of the throttle valve control device.
Figure 4:
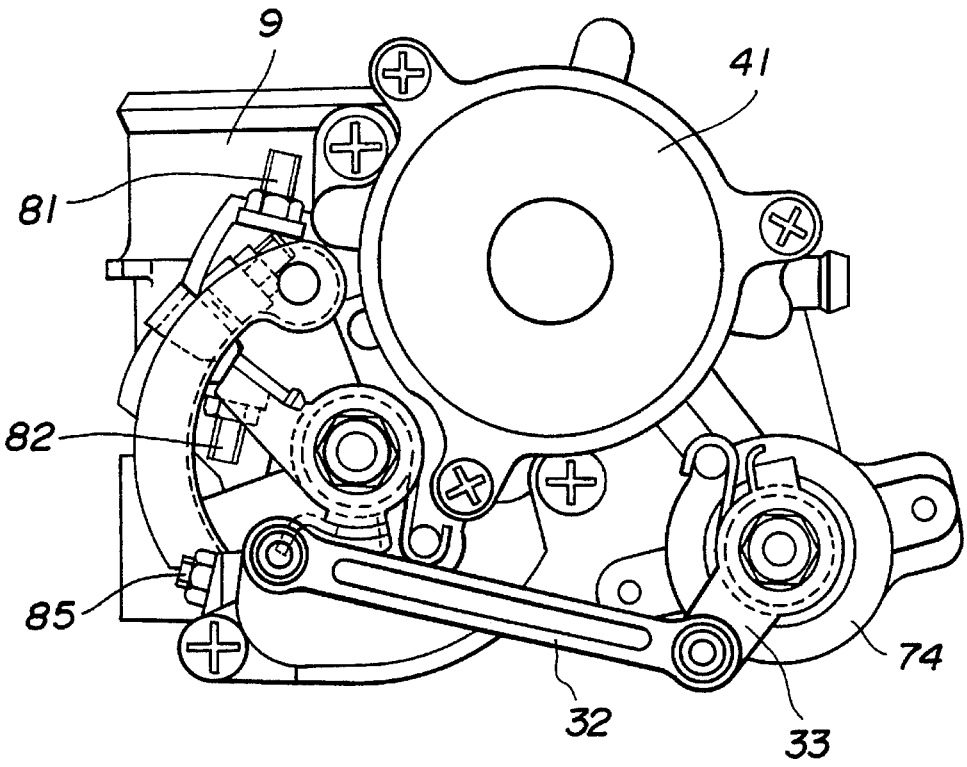
FIG. 4 is a side view of the throttle valve control device.

In FIG. 1, denoted by numeral 2 is a throttle shaft to which a butterfly-type throttle valve 3 is secured to pivot therewith. As is seen from FIG. 3, the throttle valve 3 is housed in a throat body 9 having the throttle shaft 2 pivotally supported by the throat body 9.

As is seen from FIG. 1, a spring 4 is connected to the throttle shaft 2 to bias the throttle valve 3 to pivot in a direction to close the passage of the throat body 9. A throttle shaft lever 5 is secured at its middle portion to a right end 2*a* of the throttle shaft 2 to pivot therewith. A pin 7 (viz., third connecting portion) is connected to one end of the throttle shaft lever 5. That is, the pin 7 describes a circle when the throttle shaft 2 turns about its axis.

To the throat body 9 near a left end 2*b* of the throttle shaft 2, there is mounted a throttle valve angle sensor 71 which senses the inclination angle "θ" taken by the throttle valve 3, that is, the opening degree of the throttle valve 3. As shown in FIG. 1, a small lever 72 secured to the left end 2*b* of the throttle shaft 2 is connected to the throttle valve angle sensor 71 to transmit the pivoting movement of the throttle shaft to the angle sensor 71.

An accelerator drum shaft 22 is pivotally connected to the throat body 9, which has an axis in parallel with the axis of the throttle shaft 2. Secured at its base portion to one end of the drum shaft 22 is an accelerator drum 24 which has one end of an accelerator cable 29 connected thereto. Although not shown in the drawings, the cable 29 extends to an accelerator pedal. Thus, when the accelerator pedal is depressed, the accelerator drum 24 is turned in a clockwise direction in FIG. 1. A coil spring 28 is disposed about the drum shaft 22 to bias the accelerator drum 24 to rotate in a counterclockwise direction in FIG. 1, that is, in a direction to raise the accelerator pedal, that is, in an inoperative direction of the accelerator pedal. A accelerator lever 25 is secured to the other end of the accelerator drum shaft 22 to pivot therewith. Thus, the drum shaft 22, the accelerator drum 24 and the accelerator lever 25 constitute a single unit.

A free end of the accelerator lever 25 is equipped with a pin 27 (viz., first connecting portion). Thus, the pin 27 describes a circle when the drum shaft 22 turns about its axis.

The accelerator drum 24 is equipped with a stopper 85 which is brought into contact with a fixed member (not shown) when, due to the biasing force of the coil spring 28, the accelerator drum 24 is turned in the inoperative direction of the accelerator pedal by a given angle. Thus, the turning of the accelerator drum 24 in such inoperative direction is limited. The stopper 85 shown is an adjustable screw, so that the stop position of the accelerator drum 24 is adjustable.

The accelerator drum 24 has a stud portion to which one end of a link 32 of a link mechanism 31 is pivotally connected. The other end of the link 32 is pivotally connected to a free end of another link 33 whose base is connected to an accelerator drum angle sensor 74. The sensor 74 is mounted to the throat body 9. Thus, the angle taken by the accelerator drum 24, that is, the depression degree "DD" of accelerator pedal can be detected by the sensor 74.

A step motor 41 serving as an actuator is mounted to the throat body 9, which has an output shaft 42 in parallel with the throttle shaft 2. A shaft 44 is rotatably supported by the throat body 9 at a position between the output shaft 42 and the accelerator drum shaft 22. A wing-like drive lever 45 is secured to the shaft 44 to pivot therewith. One wing portion of the drive lever 45 is equipped with a pin 47 (viz., second connecting portion) and the other wing portion of the lever 45 is formed with a sector gear 48. The pin 47 describes a circle when the shaft 44 turns about its axis. The sector gear 48 is meshed with a pinion 43 secured to the output shaft 42 of the step motor 41. Thus, upon energization of the step motor 41, the wing-like drive lever 45 is turned about the axis of the shaft 44.

As is best shown in FIG. 1, the wing-like drive lever 45 is formed with an arm 45*a* having a tapered end. Upper and lower stoppers 81 and 82 are arranged to spacedly put the tapered end of the arm 45*a* therebetween, as shown. The upper and lower stoppers 81 and 82 limit the uppermost and lowermost angular positions of the wing-like drive lever 45 respectively. The stoppers 81 and 82 are adjustable screws, so that the limited angular position of the drive lever 45 is adjustable.

Between the ring end 2*a* of the throttle shaft 2 and the wing-like drive lever 45, there is arranged a connection lever 51. The connection lever 51 has at its one (or lower) end a circular small opening 52 into which the pin 27 of the accelerator lever 25 is put through a bearing (not shown), at its middle portion a first elongate slot 54 into which the pin 47 of the wing-like drive lever 45 is slidably put through a bearing (not shown) and at its other end (or upper) end a second elongate slot 56 into which the pin 1 of the shaft lever 5 is slidably put through a bearing (not shown). Accordingly, the accelerator lever 25, the wing-like drive lever 45 and the shaft lever 5 are operatively connected with one another through the connection lever 51.

Due to a coil spring 88 disposed about the pin 27, the connection lever 51 is biased to pivot about the pin 27 in a direction to close the throttle valve 3, that is, in a counter-clockwise direction in FIG. 1.

Accordingly, when, under rest of the step motor 41, the accelerator pedal is depressed, the connection lever 51 is forced to turn about the pin 47 of the drive lever 45 in a direction to increase the opening degree of the throttle valve 3. While, when, under rest of the accelerator pedal, the step motor 41 is energized to run in one or other direction, the connection lever 51 is forced to turn about the other pin 27 of the accelerator lever 25 in either direction to increase or decrease the opening degree of the throttle valve 3. That is, if, due to running of the step motor 41 in one direction, the wing-like drive lever 45 is pivoted in a clockwise direction in FIG. 1, the opening degree of the throttle valve 3 increases. While, if, due to running of the step motor 41 in the other direction, the drive lever is pivoted in a counter-clockwise direction, the opening degree of the throttle valve 3 decreases. Of course, when the opening degree of the throttle valve 3 decreases, the driving torque produced by the engine is lowered.

As is shown in FIG. 1, the step motor 41 is controlled by a control unit 61 which comprises a microcomputer. The information signal (viz., the signal representing the inclination angle "θ" of the throttle valve 3) from the throttle valve angle sensor 71 and that (viz., the signal representing the depression degree "DD" of the accelerator pedal) from the accelerator drum angle sensor 74 are fed to the control unit 61. Although not shown in the drawing, information signals representing the gear position of the transmission, the vehicle speed, the engine load and the like are fed to the control unit 61 through an interface 63.

A ROM 65 for the computer of the control unit 61 stores various maps each representing the relationship between the depression degree "DD" of the accelerator pedal, the inclination angle "θ" of the throttle valve 3 and a vehicle operation condition represented by the information signals inputted to the control unit 61 through the interface 63. That is, the ROM 65 stores a plurality of interconnections between the "DD" and the "θ" using the vehicle operation condition as a parameter.

Figure 5:
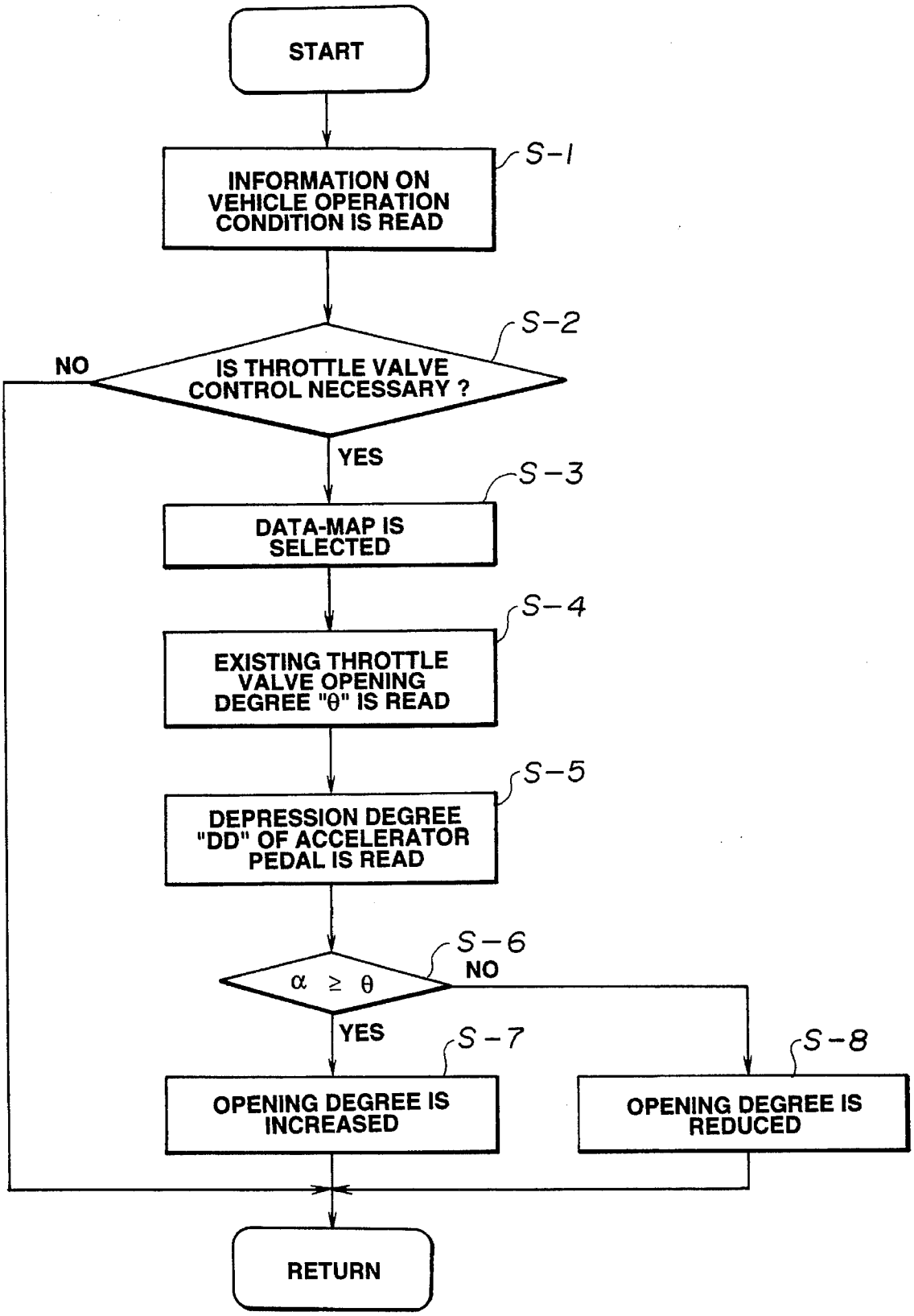
FIG. 5 is a flowchart showing programmed operation steps which are carried out in a computer used in the invention.

In the following, the control of the throttle valve 3 to which the present invention is practically applied will be described with reference to the flowchart shown in FIG. 5.

At step S-1, information signals representing the gear position of the transmission, the vehicle speed, the engine load and the like are read. That is, the existing vehicle operation condition is read at this step S-1.

Then at step S-2, a judgment is carried out as to whether the existing vehicle operation condition of the vehicle needs the open-close control of the throttle valve 3 or not. If Yes, that is, when the judgment is so made that the open-close control is necessary, the programmed operation flow goes to step S-3. At this step S-3, by analyzing the information signals, the type of the vehicle operation condition is determined (that is, whether the vehicle is under up-hill running, in traffic snarl, under high engine load running or so, and one of the maps stored in the ROM 65, which is optimum to the judged operation condition of the vehicle, is selected. If No at step S-2, that is, when the judgment is so made that the open-close control is not necessary, the programmed operation flow returns.

Figure 6:
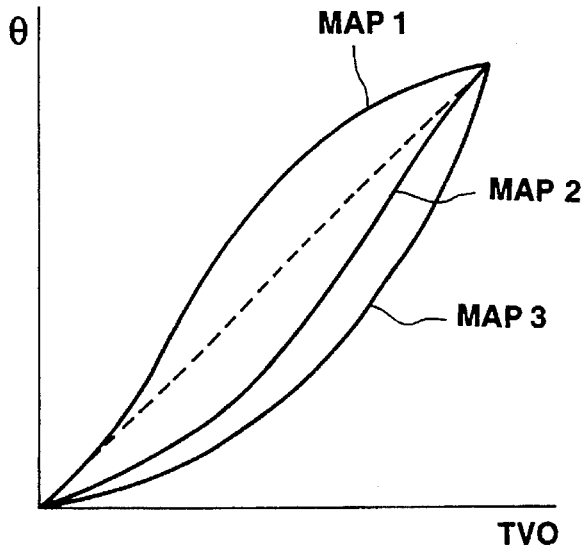
FIG. 6 is a graph showing stored data-maps used in the throttle valve control system of the present invention.

After step S-3, the operation flow goes to step S-4. At this step S-4, the existing inclination angle "θ" of the throttle valve 3 is read. Then at step S-5, the existing depression degree "DD" of the accelerator pedal is read. Then, at step S-6, comparison is carried out between a target inclination angle "α" looked up from the selected map with reference to the depression degree "DD" and the existing inclination angle "θ" of the throttle valve 3. If "$\alpha \geqq \theta$" is established, the programmed operation flow goes to step S-7. At this step S-7, the step motor 41 is controlled to pivot the throttle valve 3 in a direction to increase the opening degree thereof. That is, under this, the step motor 41 is energized to run in one direction to induce such pivot movement of the throttle valve 3. If, however, at step S-6, "$\alpha < \theta$" is established, the programmed operation flow goes to step S-8. At this step, the step motor 41 is controlled to pivot the throttle valve 3 in a direction to decrease the opening degree thereof. That is, under this, the step motor 41 is energized to run in the other direction to induce such pivot movement of the throttle valve 3. Accordingly, when the vehicle is subjected to an abnormal operation condition, the throttle valve 3 is controlled to assume an angular position appropriate for the vehicle operation condition. That is, as will be understood from FIG. 6, when the vehicle is subjected to a slip and thus the need of the traction control is determined, one map MAP-1, MAP-2 or MAP-3 is selected in accordance with the existing operation condition of the vehicle and the open-close pivoting of the throttle valve 3 is controlled in accordance with the selected map. That is, when the vehicle is subjected a slip during cruising on a slippery road, the throttle valve 3 is pivoted to decrease the opening degree of the throat lowering the driving torque produced by the engine. Thus, the undesired swerving phenomenon of the vehicle can be eliminated or at least minimized.

What is claimed is:

1. A throttle valve control system for a motor vehicle, comprising:

means for receiving an inclination angle signal representing an inclination angle of a throttle valve;

means for receiving a depression degree signal representing a depression degree of an accelerator pedal;

a memory for storing a data map representing a relationship between inclination angles and accelerator pedal depression degrees for a vehicle operation condition;

and microprocessor control means coupled to the memory and receiving the inclination angle signal and the depression degree signal, the microprocessor control means being programmed to (i) determine when the vehicle is operating under the vehicle operation condition, (ii) determine, when the vehicle is operating under the vehicle operation condition, a target inclination angle of the throttle valve based on the data map, (iii) compare the target throttle inclination angle to the inclination angle represented by the inclination angle signal, and (iv) output a control signal to control the throttle valve based on the comparison of step (iii), wherein the position of the throttle valve is thus varied according to the control signal and independent of movement of the accelerator pedal when the vehicle is operating under the vehicle operation condition.

2. A throttle valve control system as claimed in claim 1, further comprising a step motor which causes the throttle valve to pivot in a direction to increase an opening degree of the throttle valve when said target throttle inclination is greater than or equal to said inclination angle represented by the inclination angle signal and causes the throttle valve to pivot in the opposite direction when said target throttle inclination is smaller than said inclination angle represented by the inclination angle signal.

3. A throttle valve control system as recited in claim 1, wherein the vehicle operation condition is a vehicle slip condition determined in step (i) based on vehicle operation parameters.

4. A throttle valve control system as recited in claim 1, wherein the memory contains a plurality of data maps, each relating to a corresponding vehicle operation condition, the microprocessor control means being further programmed to select the data map corresponding to the current vehicle operation condition based on vehicle operation parameters, and to carry out steps (ii)–(iv) based on the selected data map.

5. A throttle valve control system for use in a motor vehicle powered by an internal combustion engine which has a throttle valve for controlling a driving torque, said control system comprising:

a first structure rotated upon operation of an accelerator pedal, said first structure having a first connecting portion;

a second structure rotated upon operation of an electric actuator, said second structure having a second connecting portion;

a third structure rotated together with said throttle valve, said third structure having a third connecting portion;

a connection lever pivotally connected to said first, second and third connecting portions, at least two of said first, second and third connecting portions being permitted to make an axial movement relative to said connection lever, so that when, under rest of said second structure, said first structure is rotated by said accelerator pedal, said first connecting portion forces said connection lever to pivot about said second connecting portion causing said third connecting portion to pivot said throttle valve, and when, under rest of said first structure, said second structure is rotated by said electric actuator, said second connecting portion forces said connection lever to pivot about said first connecting portion causing said third connecting portion to pivot said throttle valve;

first means for detecting the depression degree of said accelerator pedal;

second means for detecting the opening degree of said throttle valve;

a memory for storing a plurality of data maps, each corresponding to a relationship between said depression degree and said opening degree for a corresponding vehicle operation condition;

a control unit for selecting the data map corresponding to a current vehicle operation condition; and third means which, when said accelerator pedal is depressed by a given degree, adjusts the opening degree of said throttle valve in accordance with the data map selected by the control unit.

* * * * *